United States Patent [19]

DeVan et al.

[11] 4,398,967

[45] Aug. 16, 1983

[54] METHOD FOR INHIBITING ALKALI METAL CORROSION OF NICKEL-CONTAINING ALLOYS

[75] Inventors: Jackson H. DeVan, Oak Ridge, Tenn., granted to U.S. Department of Energy under the provisions of 42 U.S.C. 2182; James E. Selle, Westminster, Colo.

[73] Assignee: The United States of America as represented by the U.S. Department of Energy, Washington, D.C.

[21] Appl. No.: 203,195

[22] Filed: Nov. 3, 1980

Related U.S. Application Data

[63] Continuation-in-part of Ser. No. 74,288, Sep. 11, 1979, abandoned.

[51] Int. Cl.[3] ..... C23F 7/00

[52] U.S. Cl. ..... 148/6.11; 376/306

[58] Field of Search ..... 376/306, 305; 148/6.11; 165/134

[56] References Cited

U.S. PATENT DOCUMENTS 3,413,142 11/1968 Lemke ..... 427/432

3,494,805 2/1970 Wang ..... 376/306

*Primary Examiner*—Sam Silverberg

*Attorney, Agent, or Firm*—C. Clay Carter; Stephen D. Hamel; Richard G. Besha

[57] ABSTRACT

Structural components of nickel-containing alloys within molten alkali metal systems are protected against corrosion during the course of service by dissolving therein sufficient aluminum, silicon, or manganese to cause the formation and maintenance of a corrosion-resistant intermetallic reaction layer created by the interaction of the molten metal, selected metal, and alloy.

13 Claims, No Drawings

METHOD FOR INHIBITING ALKALI METAL CORROSION OF NICKEL-CONTAINING ALLOYS

This invention is a result of a contract with the U.S. Department of Energy.

REFERENCE TO RELATED APPLICATION

This application is a continuation-in-part of application Ser. No. 074,288(79) filed Sept. 11, 1979 now abandoned, entitled "Method for Inhibiting Corrosion of Nickel-Containing Alloys."

BACKGROUND OF THE INVENTION

1. Field of the Invention

This invention relates to the inhibition of corrosion in molten alkali metals of nickel-containing alloys such as nickel-based alloys, austenitic stainless steels, long-range ordered alloys, etc.

Though nickel-based alloys and stainless steels are resistant to many types of corrosive attack, there are environments in which corrosion can be a serious problem. For example, molten alkali metals such as sodium and lithium are known to attack nickel-containing alloys to a measurable degree. The corrosive interaction of these alloys and metals are of particular interest in fusion reactor technology wherein nickel-based alloys and austenitic stainless steels have been proposed for major structural elements, cooling system components, and first wall assemblies for isolating the fusion plasma from the surrounding neutron-absorbing blanket. Molten lithium, or lithium-containing compounds, have been designated as the most suitable blanket material because of the properties of lithium as a coolant, neutron absorber, and tritium fuel breeder. Molten alkali metals have also been suggested as external reactor media to remove heat for conversion to a usable energy form by means of a conventional thermodynamic cycle. Since these applications involve contact of nickel-containing alloys and molten alkali metals under conditions conducive to corrosive attack, there has been a reluctance to select nickel-containing alloys because other structural candidates have more favorable corrosion resistance. A detailed analysis of such considerations can be found in Fraas, A. P., "Conceptual Design of the Blanket and Shield Region and Related Systems for a Full Scale Toroidal Fusion Reactor," ORNL-TM 3096, Oak Ridge National Laboratory, Oak Ridge, Tenn. (May 1973), which is incorporated herein by reference. Copies of this publication are available from the National Technical Information Service, U.S. Department of Commerce, Springfield, Va.

Another environment in which nickel-containing alloys could be attacked by molten alkali metals is in a thermodynamic cycle for steam generation from a nuclear reactor. Such an apparatus is described in commonly assigned U.S. Pat. No. 4,072,183 issued to Arthur P. Fraas for "Heat Exchanger with Intermediate Evaporating and Condensing Fluid."

Corrosion of nickel-containing alloys is a problem in other environments such as those associated with molten salts used in coal liquefaction processes, batteries, and in nuclear reactor systems employing a circulating fused fluoride salt as fuel. Corrosion-resistant materials are necessary in these applications to contain the aggressive corrosion behavior of the alkali metals without adversely affecting the nuclear properties of the system.

2. Description of the Prior Art

A widely used corrosion prevention method is the application of corrosion-resistant coatings to metals. In the prior art protective aluminum coatings have been applied by physically covering a surface with an aluminum-containing powder and heating in a reducing environment to about 1000° C. to cause the deposition of aluminum. Such processes which involve the packing of solid material (known as Pack processes) are generally not applicable to complex geometries. Typically, individual parts of complex apparatus are treated prior to assembly and critical joint areas such as weldments are left unprotected in the assembled apparatus.

A fusion reactor application of a similar process wherein aluminum or beryllium oxides are plasma sprayed onto a structural material is described in commonly assigned U.S. Pat. No. 4,004,890 entitled "Method and Means of Reducing Erosion of Components of Plasma Devices Exposed to Helium and Hydrogen Isotope Radiation," issued Jan. 25, 1977.

Another method for applying protective coatings to metals is the deposition of metallic coatings from a molten salt. One such process is described in commonly assigned U.S. Pat. No. 3,783,014 entitled "Electroless Coating of Molybdenum on Stainless Steels," issued Jan. 1, 1974. The deposition of coatings from liquid metals was described by O. M. Zbozhnaya et al. in "Preparation of Diffusion Coatings by Isothermal Mass Transfer in Molten Metals," Fiz.-Khim. Mekh. Mater. 1973 9(4), pp. 43–48, Chemical Abstracts, 51010N. These workers report the isothermal mass transfer of Be, B, Al, V, Cr, Ga, Ge, Ni, Nb, Mo, W, and Pt from molten Ca, Li, Na, Bi, Pb, and Cd alloys at 800°–1000° C. onto Armco iron. The integrity of the coatings was not described.

Yet another deposition process for producing protective coatings from alkali metals is described in U.S. Pat. No. 3,481,770 issued Dec. 2, 1969, in the name of Charles H. Lemke entitled "Process for Preparing Alloy Diffusion Coatings" wherein metal substrates are immersed in baths to obtain coatings which are not fully characterized.

In the foregoing prior art processes, the protective coating, once formed, is sacrificed during corrosive service without further attempts to heal or maintain the initial coating at a desired thickness. The maintenance of such a protective coating would tend to ameliorate. reduce, or eliminate the corrosive effects of alkali metals without adversely affecting their characteristic properties.

STATEMENT OF THE OBJECTS

It is an object of this invention to provide a technique for inhibiting corrosion of nickel-containing alloys by molten alkali metals, particularly lithium.

It is a further object to provide a method for forming and maintaining a corrosion-resistant surface which can be applied in situ to complex shapes on just the surface needing corrosion protection.

It is a further object to provide a method for forming corrosion-resistant surfaces on components of an apparatus after the apparatus is assembled and placed into service without interruption of the assigned function of that apparatus.

SUMMARY OF THE INVENTION

In a closed apparatus having nickel-containing alloy components therein, this invention is the method of inhibiting corrosion by molten alkali metals comprising the initial addition to the molten alkali metal of a metal selected from the group of aluminum, silicon, and manganese in an amount sufficient to cause the formation of a corrosion-resistant coating on said nickel-containing alloy and subsequent additions of the same metal as needed to maintain said coating at a thickness sufficient to prevent corrosion of said alloy. The preferred operating temperature is 600°–1000° C. for the practice of this invention.

The method is suitable for nickel-containing alloys in general, such as austenitic stainless steels; Inconel alloy 600 containing by weight 76% Ni, 15.5% Cr, and 8% Fe and Incoloy alloy 800 containing by weight 32.5% Ni, 46% Fe, and 21% Cr plus impurities or additives as are known in the art; and long-range ordered alloys having the composition by weight 22–23% V, 14–50% Fe, and the remainder nickel or nickel plus cobalt.

The invention has particular utility in fusion reactors because nickel-containing alloys and molten lithium or other alkali metals are in contact under corrosive circumstances in numerous fusion reactor sub-systems. For example, the first wall material of a nuclear fusion reactor will be in direct contact with the molten lithium blanket. The (n,$\alpha$)t reactions which are occurring within the blanket to breed additional tritium fuel present additional problems to the known lithium attack. Energetic charged particles or neutrons can bombard the wall causing potential accumulation and blister formation which erode the surface threatening its structural and mechanical integrity. The adverse effects of such erosion mechanisms are explained in detail in Behrisch, R., "First-Wall Erosion in Fusion Reactors," Nuclear Fusion 12, 695 (1972). Additionally, tritium generated within the blanket may permeate the first wall and escape subsequent use to fuel the reactor. The use of containment mechanisms for tritium by coated structural materials has been described in articles such as Strehlow, R. A., et al, "The Permeation of Hydrogen Isotope Through Structural Metals at Low pressures and Through Metals with Oxide Film Barriers," Nuclear Technology 22, 127–137 (1974). The intermetallic layers formed and maintained by the practice of the present invention in a fusion reactor are considered adequate to solve, avoid, or ameliorate the foregoing problems of lithium corrosion, tritium permeation through the first wall, and energetic neutron or particle absorption within the first wall.

BRIEF DESCRIPTION OF THE DRAWINGS

FIG. 1 comprises two photomicrographs showing the corrosive effect of flowing molten lithium on a type 316 austenitic stainless steel surface. The surface of the upper plate was exposed to flowing lithium at 600° C. for 3000 hours. The surface in the lower plate was exposed to flowing lithium, which initially contained 5 weight percent aluminum, at 600° C. for 3000 hours.

FIG. 2 is a photomicrograph showing the effect of static molten lithium on an Inconel alloy 600 (76.0% Ni, 15.5% Cr, 8.0% Fe) surface.

FIG. 3 is a photomicrograph showing the effect of static molten lithium containing 5 weight percent aluminum on an Inconel alloy 600 surface.

DETAILED DESCRIPTION OF THE INVENTION

According to this invention, aluminum, silicon, or manganese are dissolved within a molten alkali metal to chemically react with the surface of a nickel-containing alloy confining the molten metal within a closed system under service to cause the formation and maintenance of a corrosion-resistant intermetallic compound reaction layer.

According to this method a complex apparatus having nickel-containing components, such as a heat exchanger, fusion reactor, piping system, etc., can be assembled; and the assembled apparatus filled with a molten alkali metal containing a predetermined amount of aluminum, silicon, and/or manganese dissolved therein. Under normal operating conditions, the assembled and filled apparatus is maintained at an elevated temperature, preferably within the range of 500°–800° C. Under these conditions, only the exposed nickel-containing surfaces, including weldments, are coated with an intermetallic compound reaction layer upon the passage of sufficient time for an intermetallic reaction to occur between the nickel-containing alloy and the dissolved metal in the molten alkali metal. By providing the intermetallic surface layer after assembly of the apparatus, the prior art requirement that corrosion-resistant coatings be removed at joints prior to welding, brazing, and assembling of components is eliminated. Further, joints and other areas which are not protected by prior art processes are thereby protected. Finally, the coating is applied to only the side exposed to the corrosive environment as compared to all sides in prior art immersion processes.

Deposition of an intermetallic reaction layer of Ni-Al, Ni-Si, or Ni-Mn takes place according to the method of the present invention at temperatures of about 500° C. or more. Below about 500° C., reaction rates are generally too slow for practical applications. The preferred temperature for applying the coating is about 600°–1000° C., with 600°–800° C. suitable for most applications. The method of this invention is generally applicable to alloys containing about 10% or more nickel. Iron-containing alloys with nickel contents lower than 10% tend to form ferrous intermetallic reaction layers which are less corrosion-resistant than the nickel intermetallics of this invention.

The desired thickness of the initial intermetallic reaction layer depends on the contemplated use environment and service life. About 10 micrometers is sufficient thickness for nickel-aluminum intermetallics for use in molten lithium enivornments. Thicker or thinner coatings may be suitable for other environments. The thickness of the intermetallic reaction layer depends upon the conditions at which the layer is formed. High temperatures, high-nickel contents in the alloy and high concentration of aluminum, silicon, or manganese in the molten alkali metal favor the formation of thicker intermetallic coatings for a given reaction time. Silicon generally should provide a thicker intermetallic layer than will aluminum, and manganese generally should provide a thinner intermetallic layer than will aluminum for a given alloy and a given set of reaction conditions. Suitable alloys for protection against corrosion according to this invention include austenitic stainless steels such as types 302, 303, 304, 308, 316, 347, etc., and any of the nickel-based alloys, for example, Inconel alloy 600 containing by weight 76% Ni, 15.5% Cr and 8% Fe. Other nickel-containing alloys for which this corrosion protection process is applicable are Incoloy alloy 800 containing by weight 32.5% Ni, 46% Fe, and 21% Cr and the long-range ordered alloys containing by weight 22–23% V, 14–50% Fe, and the balance Ni or Ni plus Co.

The concentration of the selected metal to be maintained in the molten alkali metal solution can range from the saturation concentration down to a predetermined fraction of the saturation concentration depending on the time and temperature, as well as the species of molten alkali metal, to which the nickel-containing alloy is exposed during its service life. To achieve high reaction rates, the alkali metal melt should initially contain as high a concentration of aluminum, silicon, or manganese as the solubility permits. Thereafter, the concentration should be sufficient to maintain the protective coating and to cure, heal or ameliorate any breach or corrosive attack of it. Subsequent additions to maintain a level of concentration can be made by continuous or batch additions of the dissolved metal depending upon temperature, corrosive aggressiveness of the alkali metal, and related circumstances.

For example, initial concentrations of 5 wt.% aluminum in molten lithium are described herein which produced satisfactory corrosion inhibition without any subsequent additions of aluminum. Although this was an experimental demonstration, it is believed that such results can be reproduced in commercial installations by monitoring the molten alkali metal system for indications of corrosion or selected metal depletion by conventional techniques known within the art and thereafter dosing the system with additional quantities of the selected metal to maintain the protective layer and thereby to prevent corrosive attack. Alternatively, the dissolved metal may be maintained at a constant, predetermined fraction of its saturation concentration by continuous addition of the selected metal.

However, it is not expected that more than 5 wt.% of the dissolved metal within the molten alkali metal will ever be necessary to form and maintain the protective intermetallic coatings according to this invention.

The temperature, reaction time, and percent saturation concentration necessary to produce and maintain a corrosion-resistant coating of a desired thickness on a particular nickel-containing alloy can be easily determined as described herein by those skilled in the art of metallic surface treatment through the use of routine tests. The following examples illustrate the effectiveness of the method of this invention for protecting nickel-containing alloys from corrosion by alkali metals, specifically molten lithium.

EXAMPLE 1

The following example illustrates the significant increase in corrosion inhibition in a flowing lithium system afforded by the method of the present invention by comparing an unprotected reference system with a system protected through the use of dissolved aluminum.

The reference system was prepared comprising a closed rectangular loop of piping of type 316 stainless steel of $\frac{5}{8}$ inch ID and about 8 feet in total length filled with pure molten lithium. Flow was induced in the loop by heating one vertical leg and cooling the other vertical leg. Each vertical leg contained interlocking sheet specimens. Base line tests were performed wherein test specimens of type 316 stainless steel were suspended in both the hot and cold legs.

Measurements of weight changes and metallographic examination of the coupons of the reference system showed a weight loss of 33 g/m$^2$ or a corrosion rate of 0.44 mil/yr., i.e., 11 micrometers/yr. The weight loss was accompanied by a phase transformation of the 316 stainless steel to a depth of 16 micrometers below the plane of lithium contact.

In an identically prepared apparatus, aluminum was dissolved in the molten lithium in an amount of about 5 wt.% of the lithium in the loop to provide a protective layer in accordance with the invention. The loop was operated without interruption for 3000 hours whereupon the effects of corrosion upon the test specimens were evaluated. The cold leg of the loop in both tests was maintained at about 400° C. and the hot leg was maintained at about 600° C. This temperature differential induced flow in the systems and demonstrated the temperature dependence of the reaction layer formed by the method of the present invention since 400° C. is below the preferred operating range. The system using dissolved aluminum according to the invention demonstrated a 6 g/m$^2$ weight loss for a corrosion rate of 0.08 mil/yr. or 2 micrometers/yr. This represents a 500% increase in corrosion resistance. Furthermore, there was no change in the microstructure of the 316 stainless steel beneath the intermetallic reaction layer. Visual inspection of the loop indicated the formation of a reaction layer about 10 micrometers thick in the hot leg maintained at 600° C. and an almost imperceptable layer in the leg maintained at about 400° C. Analysis of the lithium showed the dissolved aluminum concentration at the end of this test to be less than 0.5 wt.%.

EXAMPLE 2

The corrosion resistance obtained by the use of dissolved aluminum, silicon, and manganese in static molten lithium is demonstrated in the following example by a net gain in weight of the specimens during exposures of 500 to 5000 hours over various temperature and concentration ranges.

A number of type 316 stainless steel corrosion coupons were encapsulated in type 316 stainless steel cylinders with static lithium containing dissolved aluminum. The effects of various amounts of aluminum at several times and temperatures are shown in Table 1. Reaction layers of intermetallic compounds were formed at all test temperatures. Post test analysis showed that the lithium had been depleted of aluminum, generally down to less than 0.5 wt.% at the end of the test. The extent of aluminum depletion correlates directly with the depth of intermetallic layer formed on the 316 stainless steel.

TABLE 1

Exposure of Type 316 Stainless Steel to Molten Lithium Containing Dissolved Aluminum

| Additive (wt. %) | Test Temperature (°C.) | Test Time (hr.) | Weight Change (g/m$^2$) | Metallographic Results |
|---|---|---|---|---|
| Al 2.3 | 500 | 500 | +0.8 | no attack |
| Al 2.3 | 500 | 2000 | +1.2 | no attack |
| Al 2.4 | 500 | 5000 | +1.6 | 2 μm reaction layer |
| Al 2.3 | 600 | 500 | +5.1 | 6 μm reaction layer |
| Al 2.4 | 600 | 2000 | +3.8 | 6 μm reaction layer |
| Al 2.2 | 600 | 5000 | +7.3 | 10 μm reaction layer |
| Al 2.3 | 700 | 500 | +9.3 | 14 μm reaction layer |
| Al 2.3 | 700 | 2000 | +11.4 | 34 μm reaction layer |
| Al 2.3 | 700 | 5000 | +13.2 | 42 μm reaction layer |
| Al 5.0 | 500 | 2000 | +1.1 | no attack |
| Al 4.8 | 600 | 2000 | +6.5 | reaction layer |

TABLE 1-continued

| Exposure of Type 316 Stainless Steel to Molten Lithium Containing Dissolved Aluminum | | | | |
|---|---|---|---|---|
| Additive (wt. %) | Test Temperature (°C.) | Test Time (hr.) | Weight Change ($g/m^2$) | Metallographic Results |
| Al 4.9 | 700 | 2000 | +19.3 | reaction layer |

Similar tests were conducted at 500°, 600°, and 700° C. in which type 316 stainless steel specimens were exposed to static molten lithium containing 5 wt.% dissolved manganese and molten lithium containing 10 wt.% dissolved silicon. Corrosion resistant reaction layers of Ni-Si and Ni-Mn intermetallic reaction layers were formed during the tests which protected the underlying stainless steel from corrosion by the molten lithium. The Ni-Si layer was substantially thicker and the Ni-Mn layer was thinner than the layer produced from lithium containing dissolved aluminum under similar conditions. The Ni-Si layer had the appearance of a double layer.

EXAMPLE 3

The following example illustrates the effects of static lithium on Inconel alloy 600 and type 316 stainless steel systems with and without molten aluminum being present over a range of tempratures and exposures.

A series of test specimens of Inconel alloy 600 having a composition by weight of 76.0% Ni, 15.5% Cr and 8.0% Fe and of type 316 stainless steel were encapsulated in Inconel alloy 600 and in type 316 stainless steel cylinders, respectively. The cylinders contained only lithium or lithium containing 5 wt.% aluminum. The weight changes of the specimens after exposure to elevated temperature are shown in Table 2.

The Inconel alloy 600 showed relatively heavy weight losses in pure lithium after 1000 hours at 500°, 600° and 700° C. and extensive subsurface voids were produced throughout the entire cross section of the specimen (0.060 inch). Over the same temperature range, type 316 stainless steel showed negligible weight change in static lithium and no change in microstructure.

In lithium containing 5 wt.% aluminum, both alloys developed thin adherent intermetallic coatings as shown by the positive weight change. The coating produced on the Incoloy alloy 600 was slightly thicker than that produced on the type 316 stainless steel, which thickness can be attributed to a higher nickel content of the intermetallic compound. In the tests in which aluminum was present, the Inconel alloy 600 microstructure was unaffected below the intermetallic layer.

TABLE 2

| Exposure of Inconel Alloy 600 and Type 316 Stainless Steel to Molten Lithium With and Without Dissolved Aluminum | | | |
|---|---|---|---|
| Melt | Temperature | Weight Change, $g/m^2$ | |
| Composition | (°C.) | Inconel 600 | 316 SS |
| Li | 500 | −47.3 | +0.3 |
| Li | 600 | −5.7 | −0.1 |
| Li | 700 | −227.6 | −0.3 |
| Li-5 wt. % Al | 500 | +9.3 | +1.1* |
| Li-5 wt. % Al | 600 | +17.1 | +6.5* |
| Li-5 wt. % Al | 700 | +33.1 | +19.3* |

*Exposure time of 1000 hr. for all tests expect the 316 SS/Li-5 wt. % Al series, which had 2000 hr. exposures.

FIGS. 1-3 show the effect of 5 wt.% Al in molten lithium on nickel-containing alloys. The upper plate of FIG. 1 shows a section of type 316 stainless steel exposed to pure flowing lithium at 600° C. for 3000 hours. The lower plate of FIG. 1 shows a section of type 316 stainless steel exposed for 3000 hours at 600° C. to flowing lithium containing about 5% by weight aluminum. The corrosive attack is markedly reduced and is confined to the outer surface. FIG. 2 shows the effect of pure static molten lithium at 700° C. for 1000 hours on Inconel 600 (one of the worst areas on the surface). FIG. 3 shows the effect of static molten lithium containing about 5 wt.% aluminum on Inconel 600. The corrosion protection afforded by the aluminum is quite apparent upon comparison of the respective figures.

It is contemplated that corrosion resistant intermetallic layers applied by the method of this invention can result in systems other than those specifically disclosed herein. For instance, lead-lithium alloys and beryllium are of interest in fusion reactors as well as lithium-beryllium-fluoride salts. It is within the skill of the art to substitute such materials for their equivalents utilized herein and such substitution would be within the scope of the invention.

Thus, it is apparent that a novel and continuous process for inhibiting alkali metal corrosion within a closed operating system containing nickel alloy components is provided by the method of this invention. The simple addition and maintenance of less than saturation levels of dissolved aluminum, silicon, or manganese within said alkali metal can reduce corrosion by several orders of magnitude. Preferably, said dissolved metal addition should reside within the range of 0.1 to 5.0 wt.% of the alkali metal.

What is claimed is:

1. In a closed apparatus consisting essentially of nickel-containing alloy components exposed to a molten alkali metal corrosive environment, the method of inhibiting corrosion by said molten alkali metal comprising dissolving in said molten alkali metal a metal selected from the group consisting of aluminum, silicon, and manganese in an amount sufficient to cause the formation of a corrosion-resistant coating on said exposed alloy components.

2. The method of claim 1 wherein subsequent additions of the selected metal are made as necessary to maintain said corrosion-resistant coating at a thickness sufficient to limit corrosion of said alloy during its service life.

3. The method of claim 1 wherein the amount of selected metal does not exceed its saturation concentration within the alkali metal, and is no more than 5 wt.% of the molten metal.

4. The method of claim 2 wherein subsequent additions of the selected metal are made as needed to maintain the selected metal concentration in excess of 0.1 wt.% of the alkali metal.

5. In an operating apparatus consisting essentially of nickel-containing alloy components the process of inhibiting corrosion by a molten alkali metal in contact with the interior of said apparatus comprising initially dissolving within said molten metal a minor amount of a metal selected from the group consisting of aluminum, silicon, and manganese, and thereafter maintaining said selected metal at a concentration sufficient to limit corrosion of said components by said molten metal.

6. The process of claim 5 wherein said minor amount is less than the saturation level of said selected metal within the molten metal.

7. The process of claim 5 wherein the selected metal amount is in excess of 0.1 wt.% and less than 5 wt.% of the molten metal.

8. In a closed operating system consisting essentially of nickel-containing alloy components exposed to a molten alkali metal, the process of inhibiting corrosion of said components comprising the formation and maintenance of an intermetallic reaction layer of nickel and a metal selected from the group consisting of aluminum, silicon, and manganese on said components, said layer being formed by dissolving a minor amount of the selected metal within a predominate amount of the molten metal and maintaining the concentration of said selected metal within said molten metal throughout the operating cycle of said system.

9. In a closed apparatus functioning within its operating cycle, said closed apparatus defining at least one interior compartment consisting essentially of a nickel-containing alloy used for confining therein molten lithium under corrosive conditions, the process of inhibiting corrosion in said compartment by contacting and maintaining said contact during the operating cycle, the compartment with molten lithium having dissolved therein a metal selected from the group consisting of aluminum, silicon, and manganese for sufficient time and temperature to cause an interreaction between said nickel-containing alloy and metal to form a corrosion-resistant intermetallic reaction layer on the compartment surface exposed to lithium.

10. The method of claim 1 wherein the reaction layer is Ni-Al.

11. The method of claim 1 wherein the reaction layer is Ni-Si.

12. The method of claim 1 wherein the reaction layer is Ni-Mn.

13. The method of claim 2 wherein the apparatus is monitored by conventional techniques to determine whether subsequent additions should be made based on the remaining amount of selected metal dissolved within said alkali metal.

* * * * *